United States Patent [19]

Langr

[11] 4,055,073

[45] Oct. 25, 1976

[54] DRAWING DIE FOR ELONGATED TWIST BODIES

[75] Inventor: Oldrich Langr, Tesetice, Czechoslovakia

[73] Assignee: Sigma Lutin, narodni podnik, Lutin, Czechoslovakia

[21] Appl. No.: 723,787

[22] Filed: Sept. 16, 1976

[51] Int. Cl.[2] ..... B21C 3/04

[52] U.S. Cl. ..... 72/467; 425/461

[58] Field of Search ..... 74/467; 72/467, 65, 72/64, 77, 276, 468

[56] References Cited

U.S. PATENT DOCUMENTS 2,928,528 3/1960 Kelday et al. ..... 72/467

3,186,210 6/1965 Lesher et al. ..... 72/467

*Primary Examiner*—Milton S. Mehr

[57] ABSTRACT

An improved contoured orifice configuration in the interior of a forming die for manufacturing elongated twist bodies of non-circular cross-section is described. A prescribed interior portion of the orifice in the die is formed with a cross-section corresponding to the cross-section of the body. The portion of the orifice upstream of the interior forming section is similar to the interior cross-section but increases along a spiral path that terminates at the upstream end surface of the die. A localized region of the orifice immediately upstream of the interior portion extends generally tangentially to the angle of twist of the twist body.

3 Claims, 6 Drawing Figures

DRAWING DIE FOR ELONGATED TWIST BODIES

BACKGROUND OF THE INVENTION

The invention relates to drawing dies having central orifices for working elongated blanks into twist bodies during relative angular movement of the die and the blank as the blank is advanced downstream through the die.

Drawing dies of this type are conventionally defined by spaced planar end surfaces, with the working orifice extending therebetween. The central orifice conventionally necks down from a relatively wide entry area to an interior region of the die, whose cross-section corresponds to the cross-section of the body; in general, such cross-section is non-circular in shape, and varies axially along the body in a spirit of constant radius.

One problem with such conventional dies has been the rapid wearing of the peripheral walls of the central working region of the orifice. In an attempt to compensate for such wear, the areas of the orifice adjacent the interior working region have been modified by the use of irregular profiling, arrived at either by time-consuming calculations or expensive computer-controlled facilities. In addition, such irregular profiling has been found to adversely effect the accuracy of manufacture of the twisted body.

SUMMARY OF THE INVENTION

The improved orifice contour configuration in the drawing die of the present invention avoids all of these disadvantages. Illustratively, the interior working region of the orifice is first defined during a cutout, by conventional grinding or milling techniques, of a central opening in the die which extends completely therethrough and which corresponds in cross-section to the finished cross-section of the twist body. Thereafter, employing the same tools, the opening is widened out in a region of the die extending upstream from a prescribed interior cross-section, corresponding to the working region of the die, to the upstream end surface of the die. The cutting tool is so manipulated that the cross-section of the widened upstream portion of the orifice increases continually and regularly along a spiral path of increasing radius, with the cross-section at each plane of the widened area corresponding generally in shape to, but larger than, the final cross-section of the body.

Preferably, a localized region of the orifice immediately upstream of the interior working portion extends generally tangentially to the angle of twist of the finished twist body.

In addition, it is preferable that the axial distance to the upstream region of the central die orifice correspond generally to about 1/15 th of the final axial pitch dimension of the twist body.

BRIEF DESCRIPTION OF THE DRAWING

The invention is further set forth in the following detailed description taken in conjunction with the appended drawing, in which.

DETAILED DESCRIPTION

Figure 1:
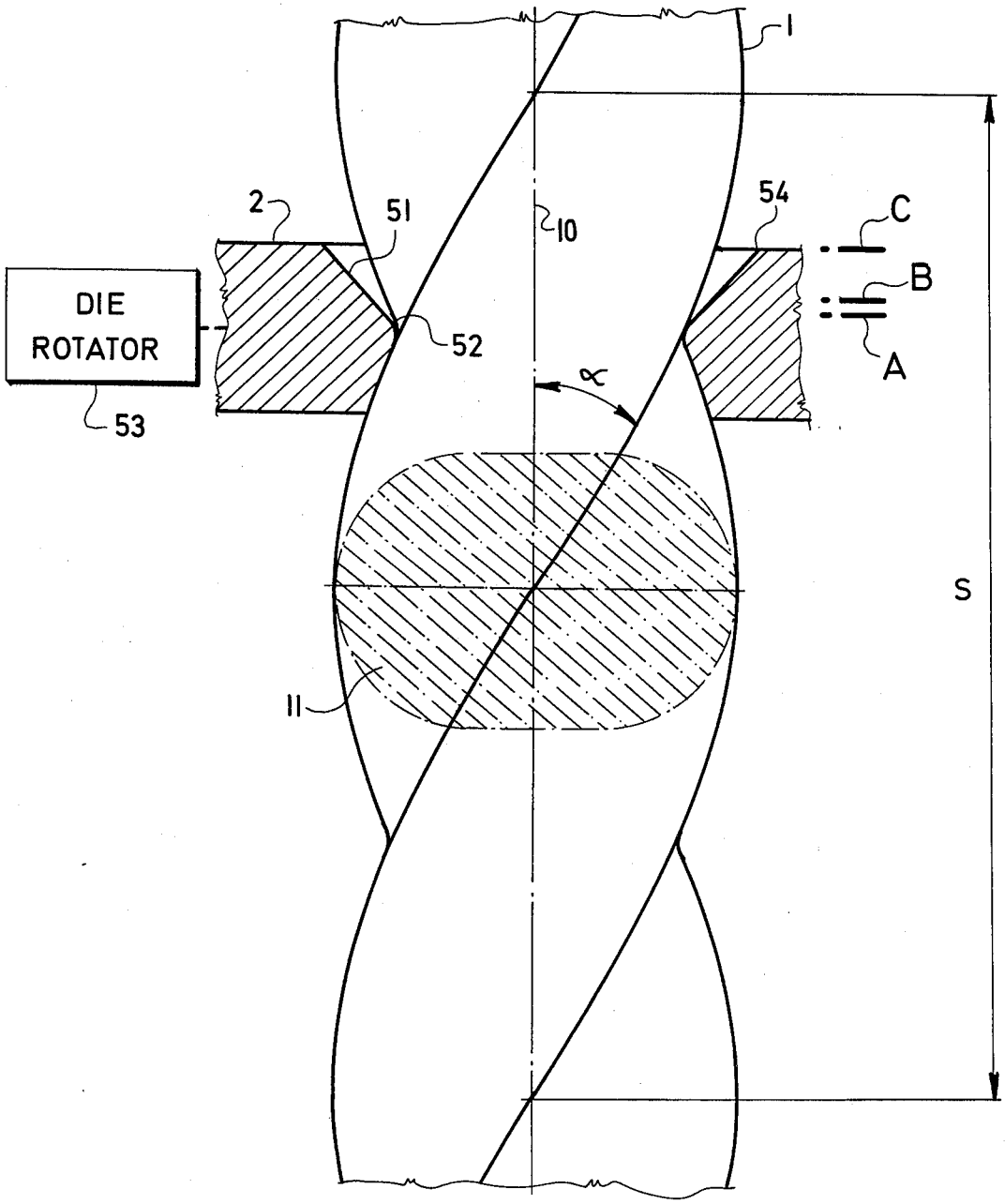
FIG. 1 PRIOR ART
FIG. 1 is a longitudinal view, partially in schematic form, of a non-circular, elongated twist body which may be formed by a drawing die of the invention, such body being shown extending through a drawing die having a conventional orifice configuration.

Referring now to the drawing, FIG. 1 illustrates an elongated twist body 1, such as in certain types of rotor spindles, which may be formed from a suitable blank which may be manufactured with the aid of a drawing die, a prior-art version of which is indicated at 2 in FIG. 1. The body 1 exhibits a non-circular (illustratively oval) cross section 11, which is depicted schematically in FIG. 1, such cross section effectively rotating about a central axis 10 of the body 1 along a spiral path of constant radius, illustrated at 6 in FIG. 2.

The angle of twist of the body 1 relative to the central axis 10 is represented by $\alpha$ in FIG. 1. Also, the axial pitch distance of the body 1 is represented at S in FIG. 1.

The die 2 represented in FIG. 1 has a central orifice 51 concentric with the axis 10, the orifice 51 converging in a central region of the die to an internal working portion 52, at which the shaping of the body 1 actually takes place. The working portion 52 has a cross section which corresponds to the cross section 11 of the finished body 1, and serves to shape the body 1 into a final form as the blank is passed axially in a downward direction as viewed in FIG. 1 through the orifice 51 while the die 2 is rotated about the axis 10 by a suitable rotating device 53.

The schematically-shown cross section 111, 112 and 113 (FIG. 2) represent the degree of rotation of the cross section 11 of the body 1 at planes respectively represented by A, B and C in FIG. 1, such planes being perpendicular to the axis 10. Thus, the cross section 111 represents the contour 11 at the plane A; the cross section 112, the contour at the plane B; and the contour 113, the contour at the plane C, which corresponds to an upstream end surface 54 of the die 2. The cross sections 111, 112 and 113 exhibit corresponding peripheral points 3, 4 and 5, which form points on the path of the constant-radius spiral 6 indicated above.

In known die designs of this general type, it has been found that excess wear of the central cutting portion 52 of the orifice 53 could be compensated only by expensive and time-consuming irregular profiling of the portion of the orifice 51 upstream of the cutting region 52. In accordance with the invention, such disadvantages are avoided by a die orifice construction having the general configuration illustrated in FIGS. 3-5 of the drawing.

Figure 4:
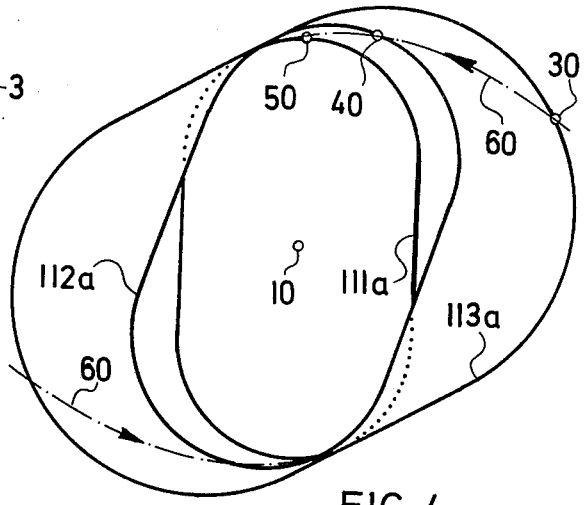
FIG. 4 is a schematic representation showing the cross-sections at a plurality of spaced axial locations in a widened upstream portion of a die orifice configuration in accordance with the invention, the three cross-sectional planes shown corresponding to planes A, B and C in FIG. 1.
Figure 3:
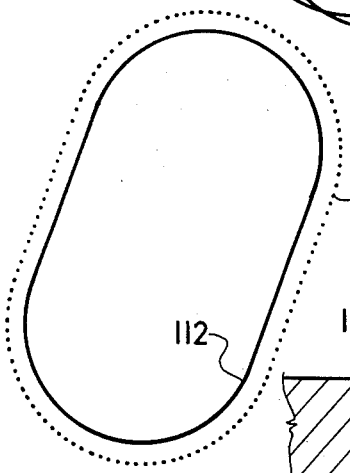
FIG. 3 is a schematic representation illustrating a comparison between the cross-section of the body at the plane B of FIG. 1 and the corresponding cross-section of a die orifice configuration in accordance with the invention at the same cross-section.
Figure 5:
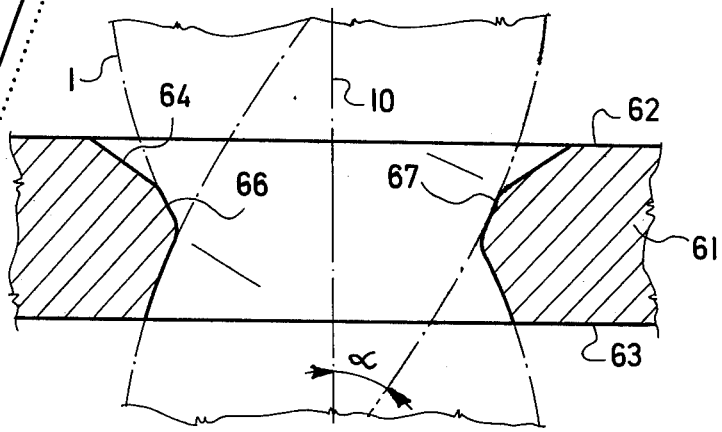
FIG. 5 is an axial view, in section, of a drawing die having an orifice configuration in accordance with the invention.

The improved die shown in FIG. 5 represented at 61, includes upstream and downstream end surfaces 62 and 63 which are interconnected by a central orifice 64 whose contour, referred to the upstream portion of the die, has the desired configuration shown in FIGS. 3 and 4. The orifice 64 has a central working region 66, which like the central orifice 52 of the die 2 in FIG. 1 has a cross section corresponding in size and configuration to the non-circular cross section 11 of the body 1. However, in the region of orifice 64 of the die 61 upstream of the working region 66, the cross section of the orifice 61 increases regularly along a spiral of increasing radius, with the largest cross section occuring at the upstream end surface 62 of the die 61.

Figure 2:
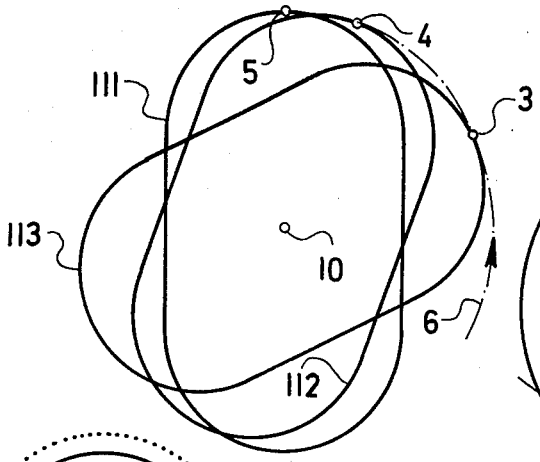
FIG. 2 PRIOR ART
FIG. 2 is a schematic representation of the non-circular cross-section of the twist body of FIG. 1, the superposed cross-sectional views of FIG. 2 corresponding to the cross-sections of the body at planes A, B and C shown in FIG. 1.

At each point of such increasing spiral, the contour of the cross section of the orifice 64 is similar to the cross section 11 of the body 1, but increases monotonically in the region corresponding to the area between planes A and C in FIG. 1; such situation is depicted most clearly in FIG. 4, wherein the cross section 111a of the orifice 64 corresponds to the twist body cross section 111 of FIG. 2, while the orifice cross sections 112*a* and 113*a* correspond respectively to the cross section 112 and 113 of the body 1 at the same planes. The above-indicated spiral of increasing radius is represented at 60 in FIG. 4, such radius passing through corresponding peripheral points 30, 40 and 50 of the orifice cross sections 111*a*, 112*a* and 113*a*. A typical comparison of the size and form factor of the cross sections 112 and 112*a* of the body 1 and the orifice 64 is given for convenience in FIG. 3.

Advantageously, a region 67 of the orifice 64 immediately upstream of the cutting edge of the working region 66 is curved outwardly tangent to the angle $\alpha$ of twist of the body 1. In addition, it has been found beneficial if the width of the die 61 is chosen such that the axial distance from the upstream end surface 62 to the curved portion 67 upstream of the working region 66 is made about 1/15 of the twist distance S of the body 1.

Figure 6:
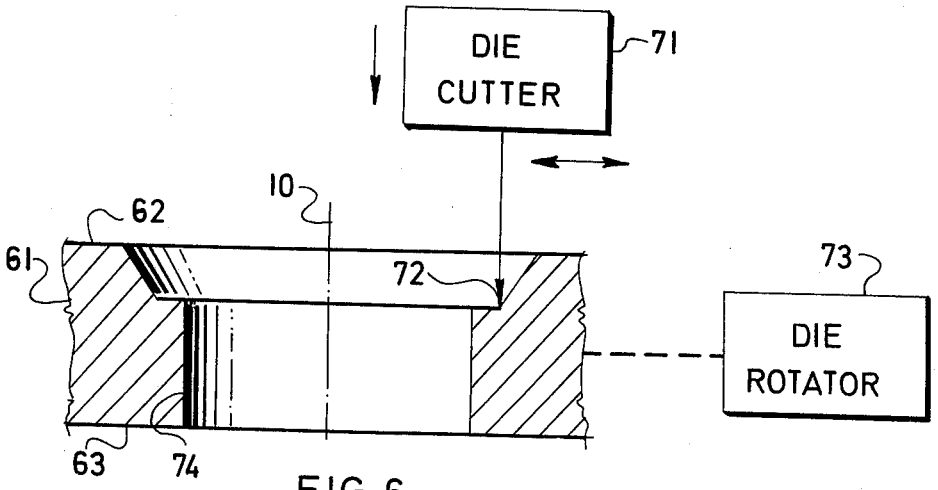
FIG. 6 is a block diagram illustrating a generalized cutting technique for defining the contoured orifice configuration of a drawing die in accordance with the invention.

FIG. 6 illustrates in block form a suitable arrangement for cutting out the orifice 64 in the improved die of FIG. 5. A die cutter 71, illustratively a lathe or grinder, is supported for movement parallel and perpendicular to the plane of the drawing. Such cutter 71 has a cutting tool represented at 72, such tool 72 being disposed in operative relation to the upper surface 62 of the die 61. A die rotator 73 may be associated with the die 61 for rotating the die about the longitudinal axis 10 during the cutting operation.

In operation, the cutting tool 72 is initially activated in a conventional manner to cut, completely through the die 62, an orifice 74 which corresponds in cross section to that of the finished central working region 66 (FIG. 5). After the orifice 74 is cut, the tool 72 is repositioned for what is essentially a counter boring operation, which may begin at the upstream surface 62 and proceed along a path of decreasing radius therefrom, corresponding to the path 60 of FIG. 4, to define the final orifice 64 of FIG. 5. The tool 72 is illustrated in an intermediate position during such counter boring operation. If desired, the rounded region 67 of FIG. 5 can be accomplished after the main counter boring operation or, alternatively, may be programmed into the positioning of the cutter 71.

In the foregoing, an illustrative configuration of a drawing die orifice and a technique for forming it have been described. Many variations and modifications will now occur to those skilled in the art. It is accordingly desired that the scope of the appended claims not be limited to the specific disclosure hereincontained.

What is claimed is:

1. In a drawing die for forming an elongated twist body during relative axial and angular movement of the die and a body-forming blank, the body having a prescribed non-circular cross-section, twist angle and axial pitch, the prescribed cross-section varying axially along the body in a spiral of constant radius, the drawing die having upstream and downstream axially spaced end surfaces and centrally disposed, orifice-defining means extending therebetween, the orifice-defining means having an interior forming portion whose cross-section corresponds to the prescribed cross-section of the twist body, the improvement wherein the cross-section of the orifice-defining means varies regularly along the die in a direction from the interior forming portion toward the upstream end surface in a spiral of increasing radius terminating at the upstream end surface.

2. A die as defined in claim 1, in which the region of the orifice-defining means immediately upstream of the interior forming portion extends generally tangentially to the twist angle of the body.

3. A die as defined in claim 1, in which the axial distance between the upstream end surface of the die and the upstream region of the interior portion of the orifice-defining means is about 1/15 th of the axial pitch dimension of the twist body.

* * * * *